US011866949B2

(12) United States Patent
Bogoian

(10) Patent No.: US 11,866,949 B2
(45) Date of Patent: Jan. 9, 2024

(54) DECK REPAIR BLOCK

(71) Applicant: Peter Bogoian, North Stonington, CT (US)

(72) Inventor: Peter Bogoian, North Stonington, CT (US)

(73) Assignee: Peter Bogoian, North Stonington, CT (US)

( * ) Notice: Subject to any disclaimer, the term of this patent is extended or adjusted under 35 U.S.C. 154(b) by 0 days.

(21) Appl. No.: 17/738,041

(22) Filed: May 6, 2022

(65) Prior Publication Data

US 2023/0358064 A1 Nov. 9, 2023

(51) Int. Cl.
*E04G 23/02* (2006.01)
*E04B 1/00* (2006.01)

(52) U.S. Cl.
CPC ..... *E04G 23/0285* (2013.01); *E04B 1/003* (2013.01)

(58) Field of Classification Search
CPC . E04G 23/0285; E04G 23/0292; E04B 1/003; E04B 1/0038; E04F 15/02183
See application file for complete search history.

(56) References Cited

U.S. PATENT DOCUMENTS 5,775,048 A 7/1998 Orchard
5,794,390 A * 8/1998 Oliveri ..... E04F 15/02 52/177
5,887,331 A * 3/1999 Little ..... E04B 1/003 52/480
6,449,911 B1 9/2002 Hudson
8,870,163 B2 10/2014 Regan
9,145,672 B1 9/2015 Broughton
10,494,814 B2 12/2019 Mei
10,605,288 B2 3/2020 Martel et al.
10,988,931 B1 * 4/2021 McManus ..... E04F 15/082
2001/0025465 A1 * 10/2001 Osfolk ..... E02B 3/068 52/177
2004/0200158 A1 * 10/2004 Nelsen ..... E04B 5/12 52/169.1
2013/0031846 A1 * 2/2013 Shaw ..... E04F 15/02183 52/741.3
2014/0007526 A1 * 1/2014 Wright ..... E04B 5/023 52/127.4
2018/0163411 A1 * 6/2018 Bachelder ..... E04F 15/02038
2020/0002936 A1 * 1/2020 Fuquea ..... E04B 1/003

FOREIGN PATENT DOCUMENTS

EP 3865641 A1 * 8/2021 ..... E04F 15/02044
FR 2921086 A1 * 3/2009 ..... E04F 15/02183
KR 20170071745 A * 6/2017
KR 20190059713 A * 5/2019
KR 20210020049 A * 2/2021
KR 20220011403 A * 1/2022

* cited by examiner

*Primary Examiner* — Theodore V Adamos
(74) *Attorney, Agent, or Firm* — Amin, Turocy & Watson, LLP

(57) ABSTRACT

Deck repair blocks, deck repair methods, and repaired decks are enabled. For example, a deck repair block can comprise: a saddle portion configured to receive a joist, a first recessed portion configured to receive a first deck board, and a second recessed portion configured to receive a second deck board.

20 Claims, 9 Drawing Sheets

DECK REPAIR BLOCK

TECHNICAL FIELD

The disclosed subject matter relates to deck components and, more particularly, to deck repair using a deck repair block.

BACKGROUND

Butt ends of deck boards (e.g., where two boards meet) of a deck (e.g., an outdoor deck) can become ruined for various reasons. The boards can become rotted, splintered, chipped, warped, or have wide, unsightly gaps. Some of these issues result from poor construction technique, while others are the result of exposure to weather for long periods of time. Nonetheless, repair of such decks can be time consuming, expensive, and can require expensive materials. Further, replacement boards may not match existing boards, leaving large unsightly repaired sections.

The above-described background relating to deck repair is merely intended to provide a contextual overview of some current issues and is not intended to be exhaustive. Other contextual information may become further apparent upon review of the following detailed description.

DETAILED DESCRIPTION

Figure 1:
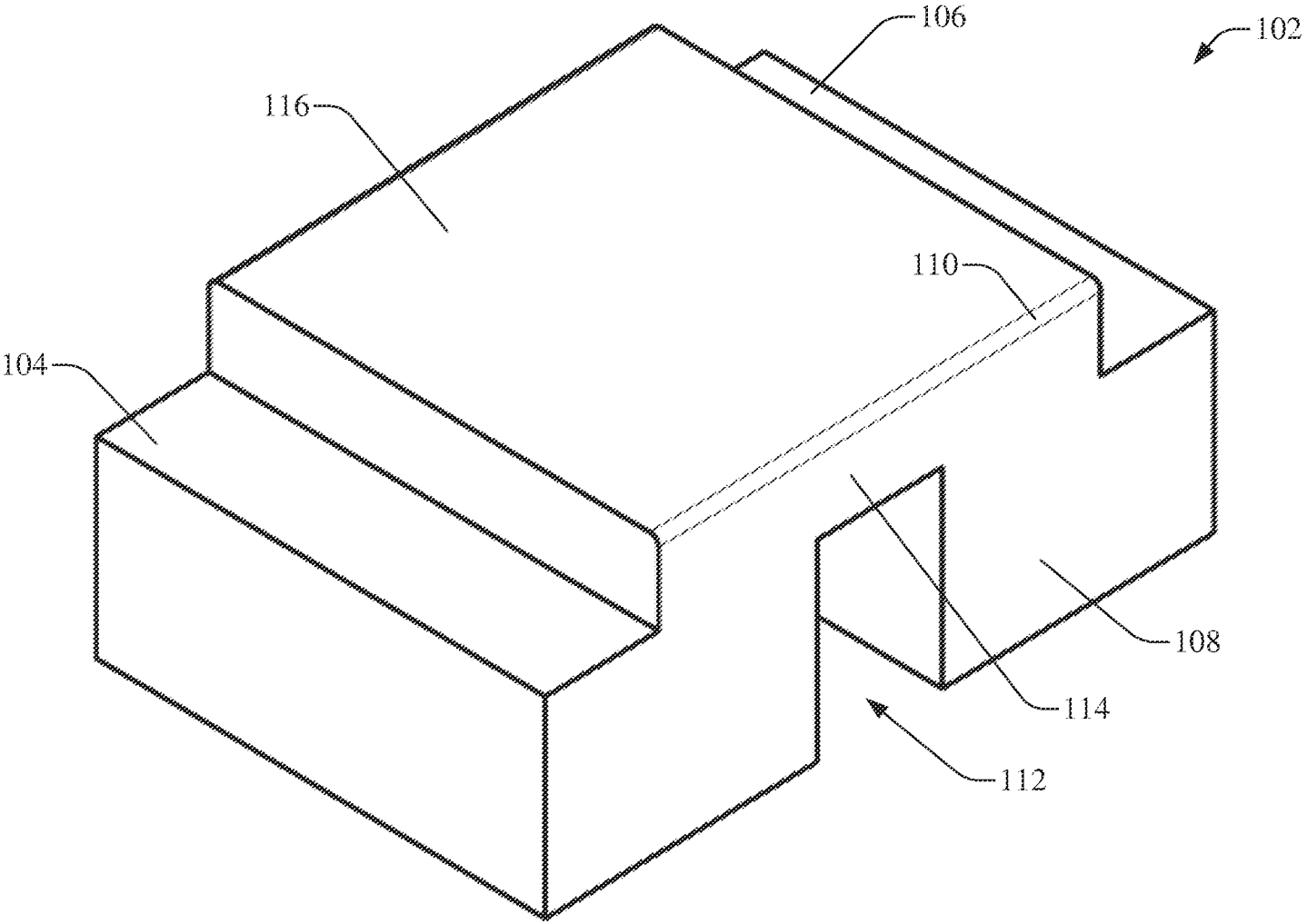
FIG. 1 is a perspective view of a deck repair block in accordance with one or more embodiments described herein.
Figure 2:
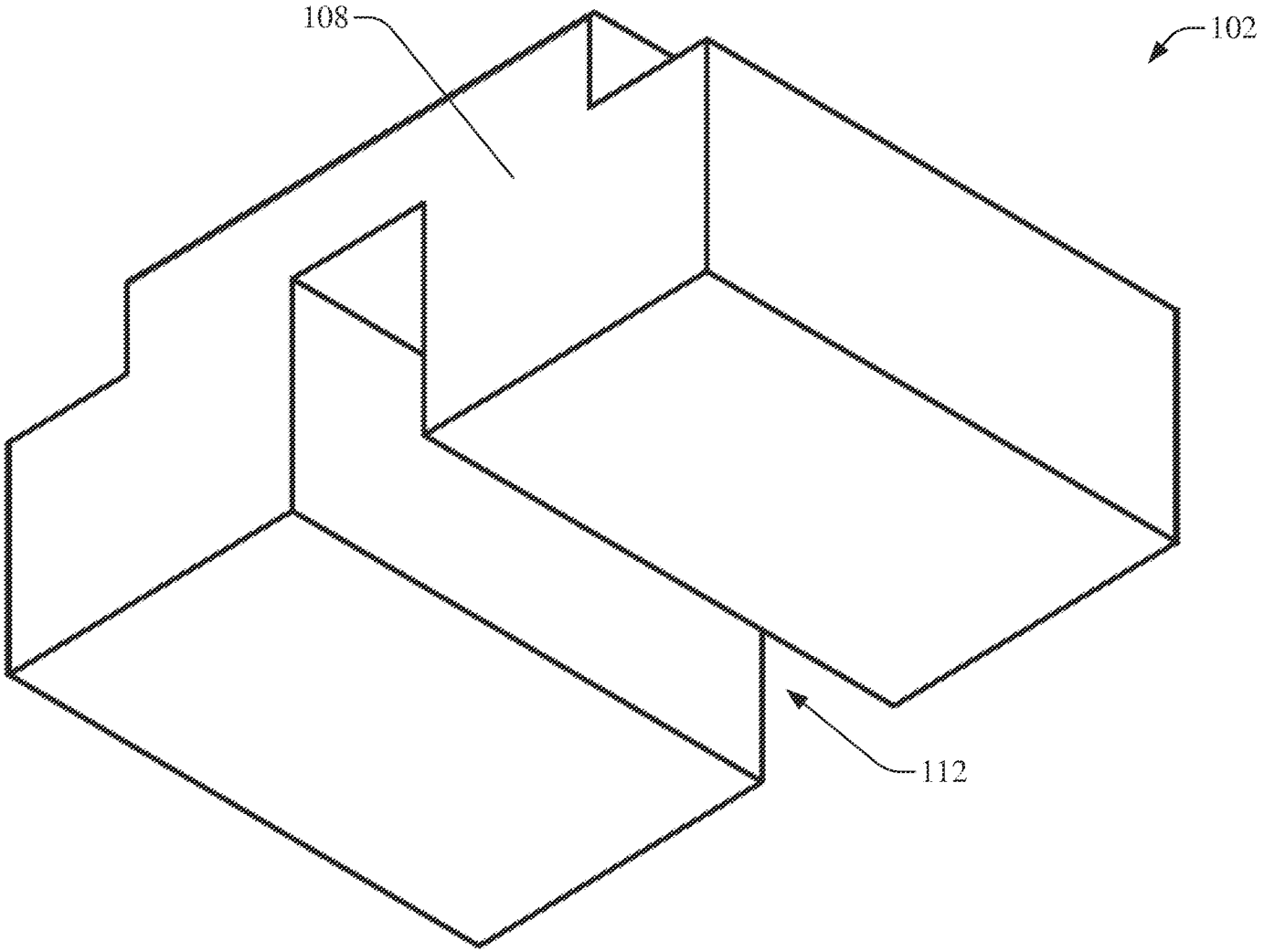
FIG. 2 is a perspective view of a deck repair block in accordance with one or more embodiments described herein.
Figure 3:
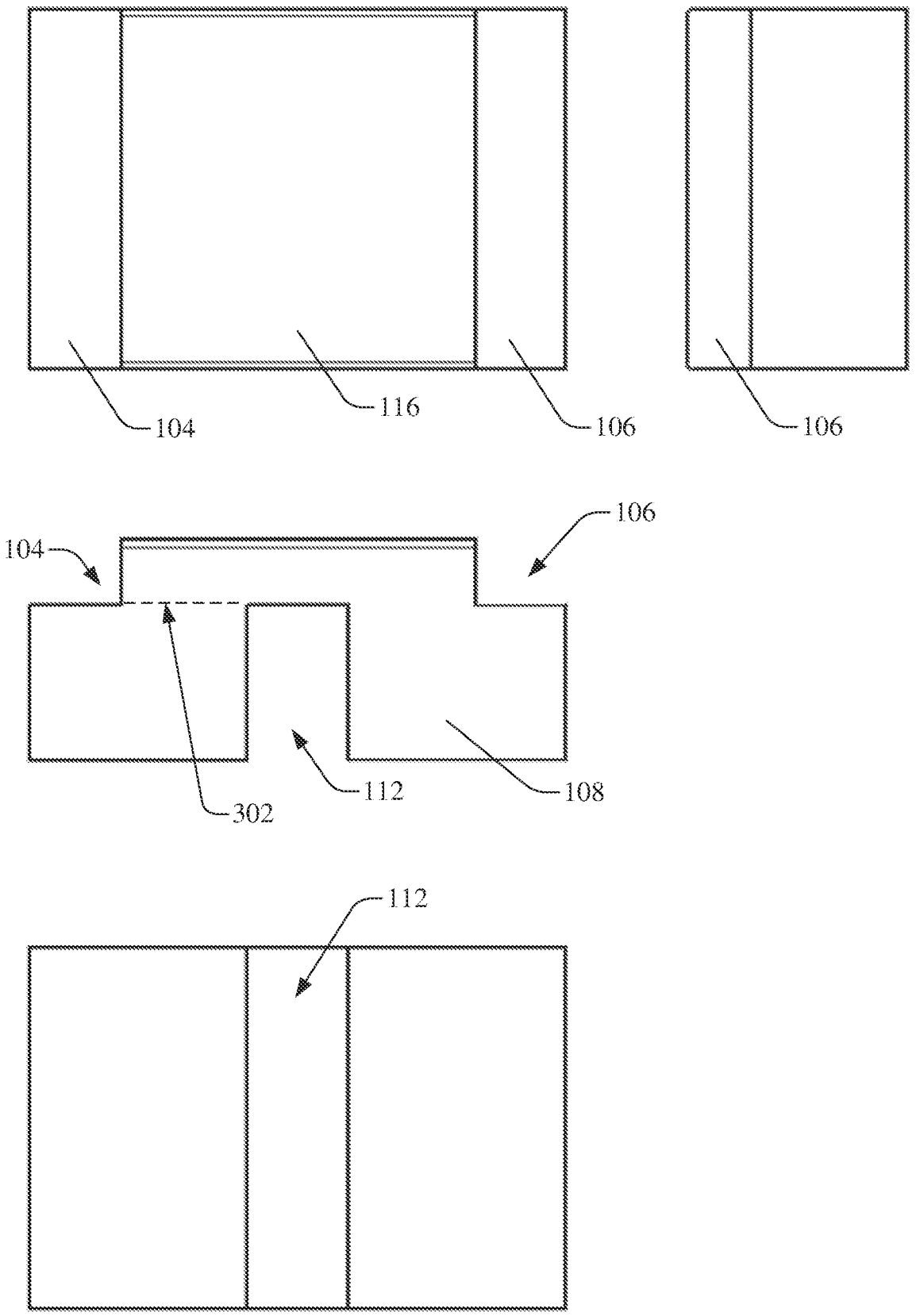
FIG. 3 is a multiview of a deck repair block in accordance with one or more embodiments described herein.
Figure 4:
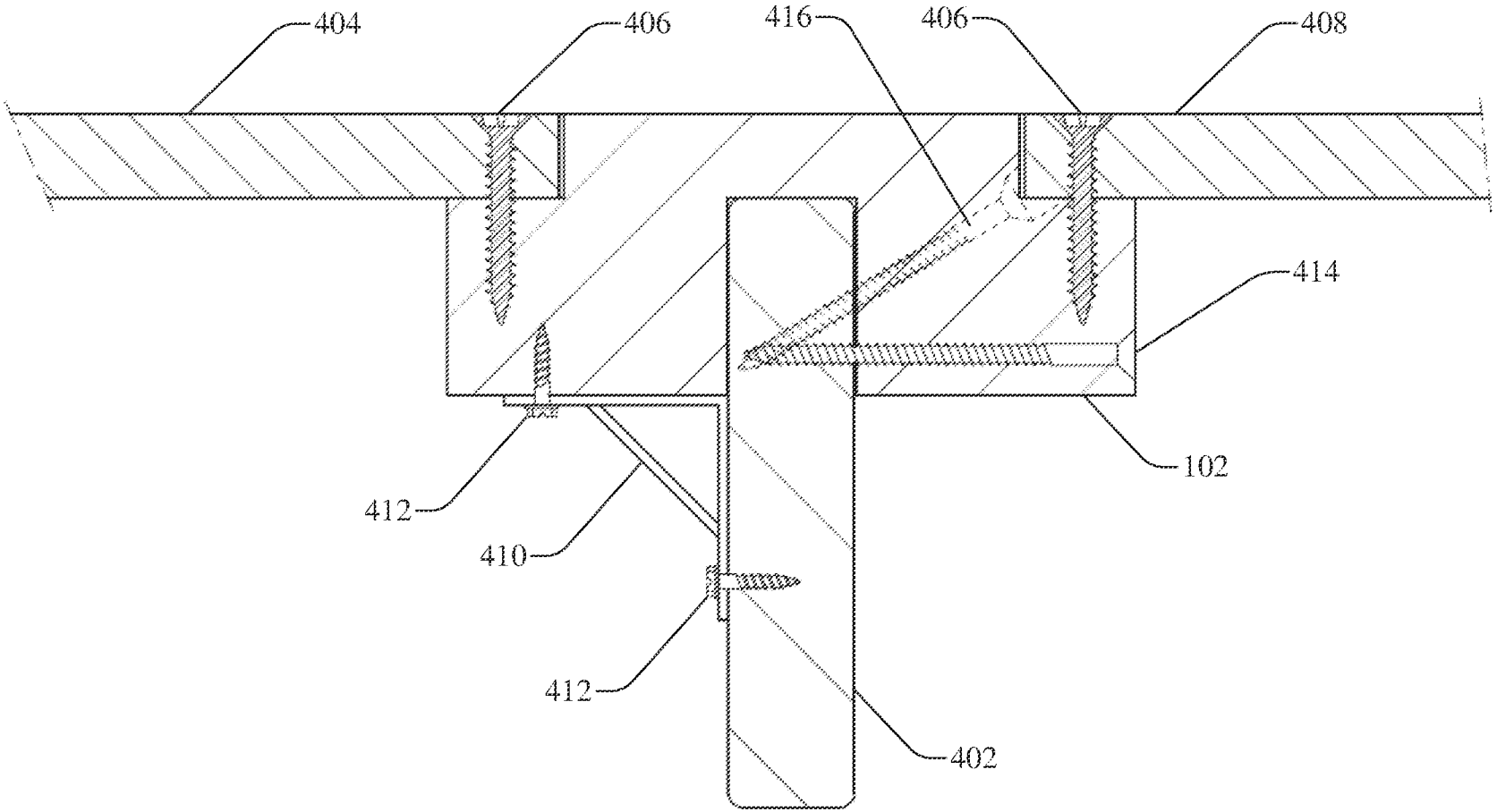
FIG. 4 is a section view of a deck repair block in accordance with one or more embodiments described herein.
Figure 5:
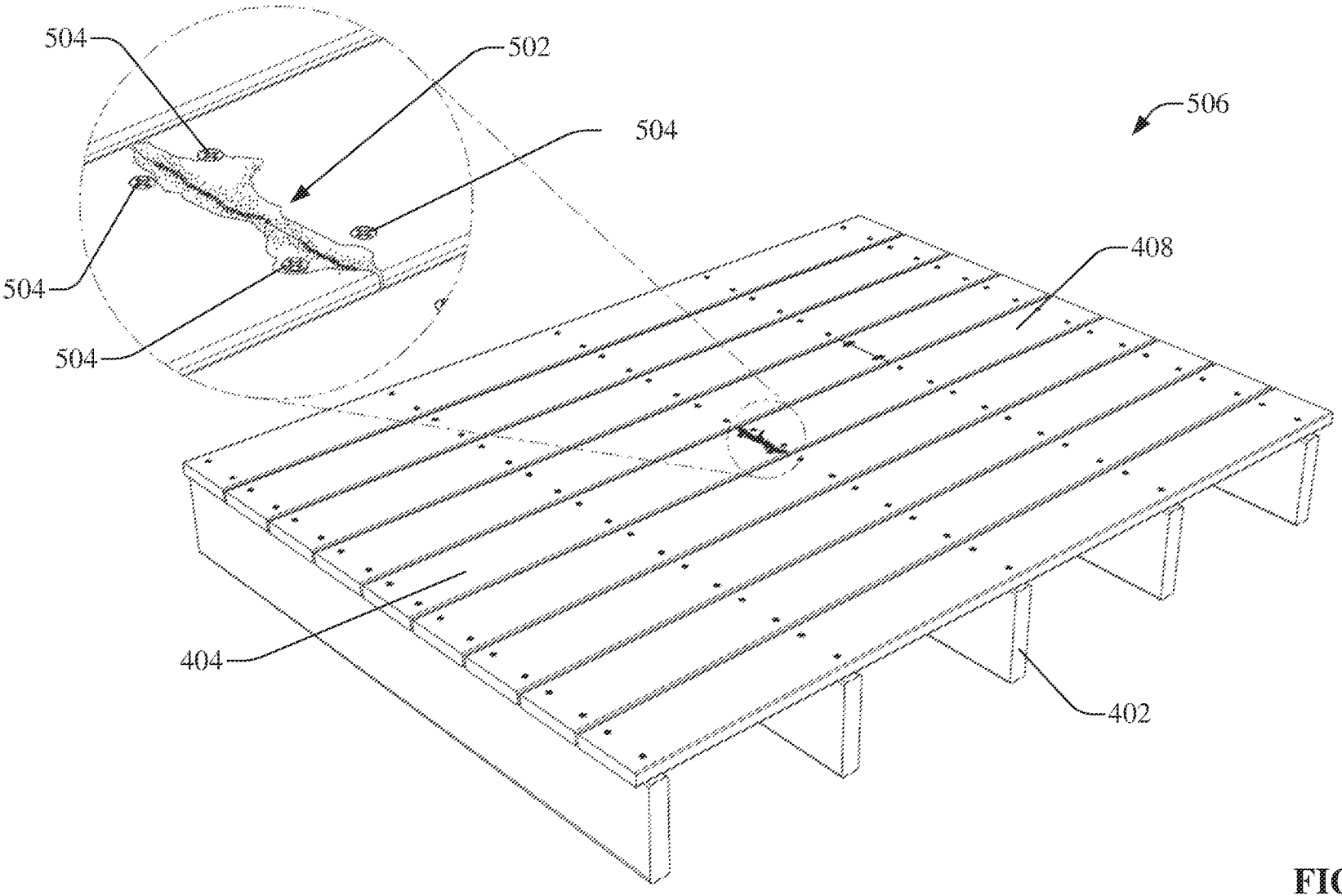
FIG. 5 is a deck in accordance with one or more embodiments described herein.
Figure 6:
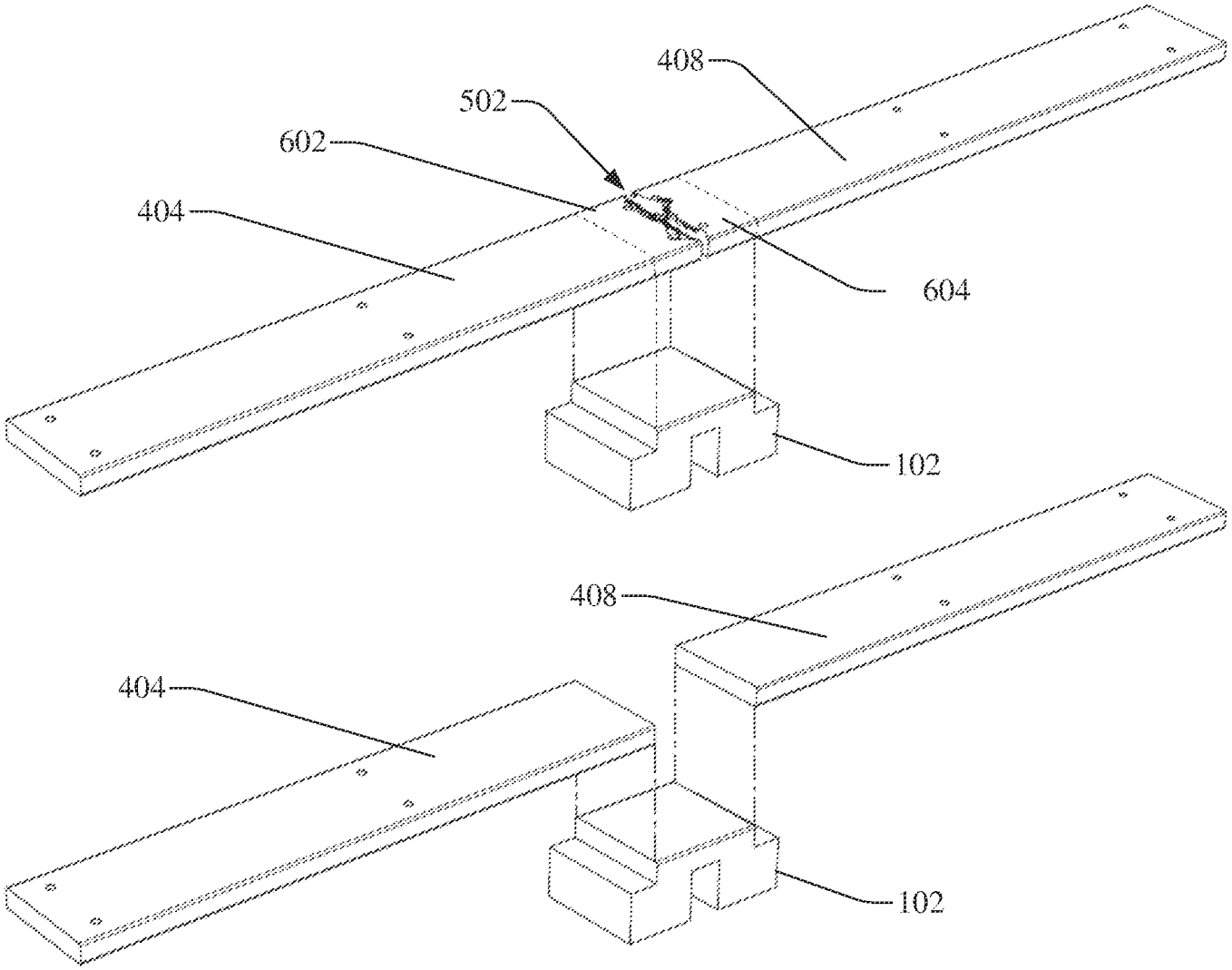
FIG. 6 illustrates a deck repair in accordance with one or more embodiments described herein.
Figure 7:
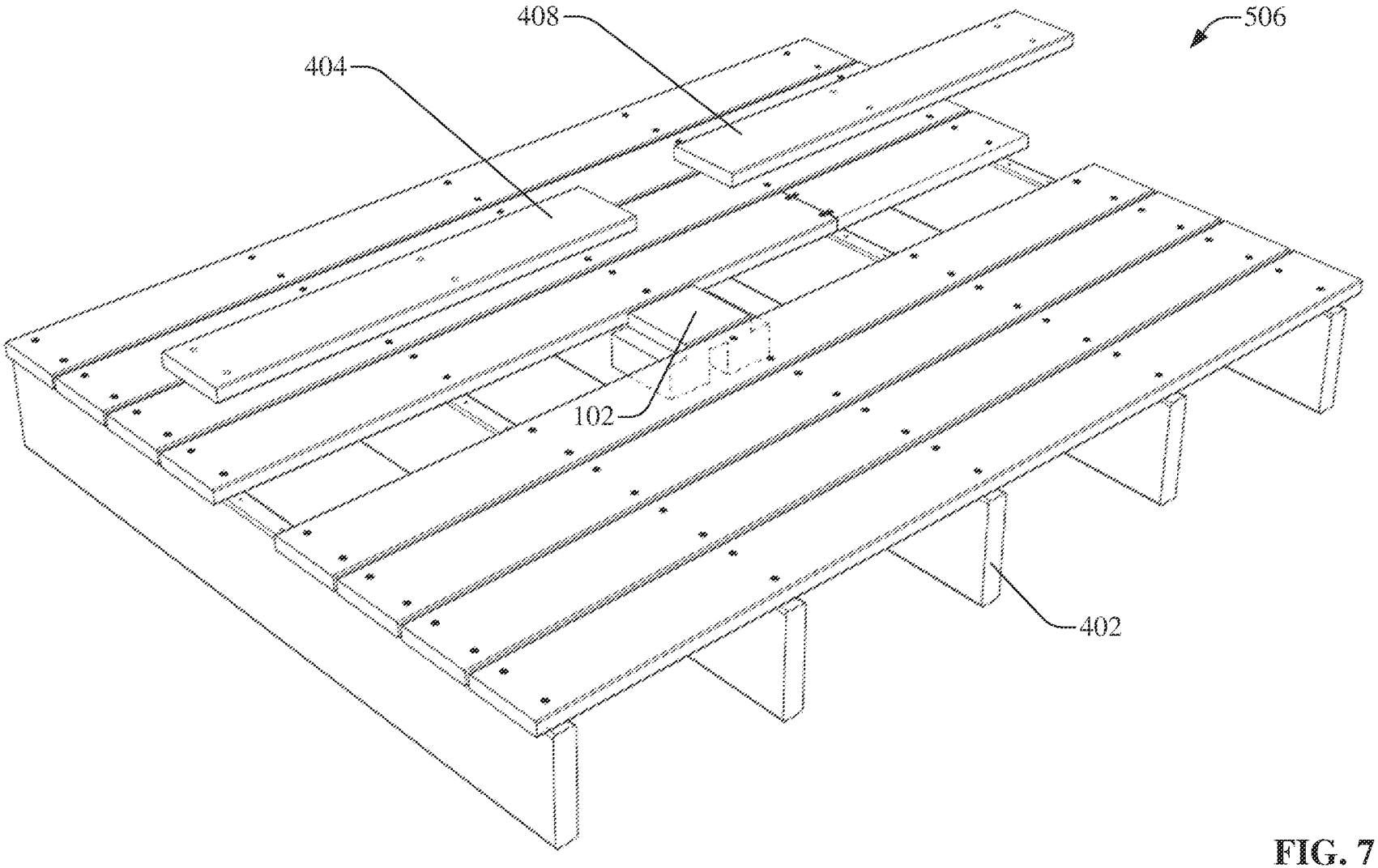
FIG. 7 illustrates a deck repair in accordance with one or more embodiments described herein.
Figure 8:
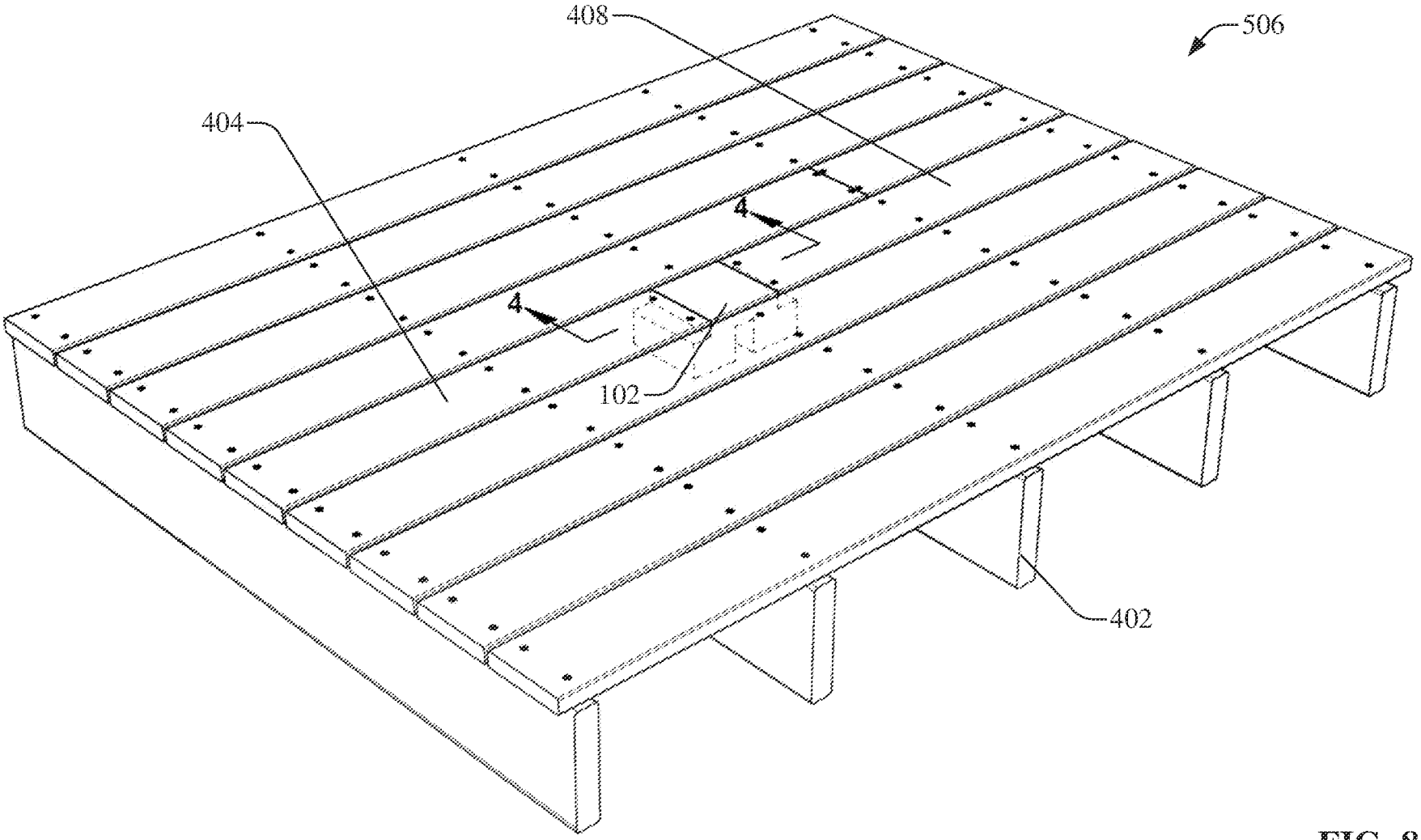
FIG. 8 is a deck in accordance with one or more embodiments described herein.

The subject disclosure is now described with reference to the drawings, wherein like reference numerals are used to refer to like elements throughout. In the following description, for purposes of explanation, numerous specific details are set forth in order to provide a thorough understanding of the subject disclosure. It may be evident, however, that the subject disclosure may be practiced without these specific details. In other instances, well-known structures and devices are shown in block diagram form in order to facilitate describing the subject disclosure.

As alluded to above, decks and deck repairs can be improved in various ways, and various embodiments are described herein to this end and/or other ends.

According to an embodiment, a deck repair block can comprise: a saddle portion configured to receive a joist, a first recessed portion configured to receive a first deck board, and a second recessed portion configured to receive a second deck board.

In various embodiments, a first depth of the first recessed portion can correspond to a first thickness of the first deck board, and a second depth of the second recessed portion can correspond to a second thickness of the second deck board. In one or more embodiments, a thickness of a deck portion of the deck repair block can correspond to the first thickness of the first deck board and the second thickness of the second deck board.

In various implementations, a width of the saddle portion can correspond to a thickness of the joist, and a depth of the saddle portion can correspond to a depth of the first recessed portion or the second recessed portion. In some embodiments, the first deck board can attach to the first recessed portion using one or more screws. In further embodiments, the first deck board can attach to the first recessed portion using an adhesive.

In one or more implementations, the deck repair block can comprise wood. In further implementations, the deck repair block can comprise a composite material. In some embodiments, an edge can be chamfered to correspond to an edge of the first deck board or the second deck board.

In another embodiment, a method for repairing a deck can comprise: removing a damaged section of the deck, wherein the damaged section comprises one or more damaged deck boards, providing a deck repair block atop a joist of the deck, wherein the deck repair block comprises a saddle portion configured to receive a joist, a first recessed portion configured to receive a first deck board, and a second recessed portion configured to receive a second deck board, providing the first deck board atop the first recessed portion, and providing the second deck board atop the second recessed portion.

In various embodiments, the one or more damaged deck boards can comprise the first deck board and the second deck board.

In one or more embodiments, the above method can further comprise: securing the first deck board to the first recessed portion with one or more screws.

In one or more embodiments, the above method can further comprise: securing the first deck board to the first recessed portion with an adhesive.

In some embodiments, the above method can further comprise: securing the deck repair block to the joist with an adhesive.

In various implementations, the above method can further comprise: securing the deck repair block to the joist with a bracket and optionally including one or more screws. The deck repair block can be secured to the joist in any suitable manner. Examples include securing the deck repair block to the joist with one or more of a bracket, with an adhesive, or with one or more screws/nails/other hardware connector.

It is noted that, in various embodiments, a length of the damaged section can correspond to a length of a top surface of the deck repair block.

According to yet another embodiment, a deck can comprise: a deck repair block received atop a joist, a first deck board received on a first recessed portion of the deck repair block, a second deck board received on a second recessed portion of the deck repair block.

In various embodiments, a top surface of the deck repair block can correspond to a damaged section of the deck. In some embodiments, the damaged section can comprise a first damaged portion of the first deck board and a second damaged portion of the second deck board.

In various implementations, the first deck board, the second deck board, and the deck repair block can comprise a common material.

It should be appreciated that additional manifestations, configurations, implementations, protocols, etc. can be utilized in connection with the following components described herein or different/additional components as would be appreciated by one skilled in the art.

Turning now to FIGS. 1-8, there is illustrated an example, non-limiting deck repair block 102 in accordance with one or more embodiments herein. The deck repair block 102 can comprise one or more of a variety of materials, such as one or more of a variety of types of wood (e.g., pressure-treated wood, cedar, redwood, hardwoods, ipe, or other suitable wood types) (e.g., milled from wood), metal (e.g., aluminum, steel, or other suitable metal types), polyvinyl chloride (PVC) plastics, composite materials, or other suitable materials. In various implementations, a first deck board 404, a second deck board 408, and the deck repair block 102 can comprise a common material, though in further embodiments, the first deck board 404, the second deck board 408, and the deck repair block 102 can comprise one or more differing materials. It is noted that the deck repair block 102 can be sized to match a size of the decking members (e.g., deck boards) of a deck 506 that it is intended to repair. Therefore, gaps between deck boards herein and the deck repair block 102 can be prevented.

According to an embodiment, the deck repair block 102 can comprise a saddle portion 112 (e.g., a milled channel), which can be configured to receive a joist (e.g., joist 402 of deck 506). In this regard, the saddle portion 112 can be received atop the joist 402, straddling the joist 402. In various embodiments, a top surface (e.g., deck portion 116) of the deck repair block 102 can correspond to a damaged section 502 of the deck 506. In this regard, a length of the top surface of the deck repair block 102 can correspond to a length of the damaged section 502 of the deck 506 (a length of the top surface of the deck repair block 102 can correspond to a length of the damaged section 502 that has been removed from the deck 506). Further in this regard, the damaged section 502 can comprise a first damaged portion 602 of the first deck board 404 and a second damaged portion 604 of the second deck board 408.

According to an embodiment, the deck repair block 102 can comprise a first recessed portion 104 (e.g., a milled shelf) configured to receive a first deck board 404 and a second recessed portion 106 (e.g., a milled shelf) configured to receive a second deck board 408. In various embodiments, a depth (e.g., a first depth) of the first recessed portion 104 can correspond to a thickness (e.g., a first thickness) of the first deck board 404, and a depth (e.g., a second depth) of the second recessed portion 106 can correspond to a thickness (e.g., a second thickness) of the second deck board 408. In this regard, a thickness of a deck portion 116 of the deck repair block 102 can correspond to the thickness (e.g., the first thickness) of the first deck board 404 and the thickness (e.g., second thickness) of the second deck board 408. The foregoing can prevent an uneven transition between the deck portion 116 of the deck repair block 102 and surfaces of corresponding deck boards to be attached to the deck repair block 102.

In one or more embodiments, a width of the saddle portion 112 can correspond to a thickness of the joist 402. It is noted that, in one or more embodiments, a depth of the saddle portion 112 can correspond to a depth of the first recessed portion 104 and/or the second recessed portion 106 (e.g., common depth 302), which can prevent an uneven transition between the deck portion 116 of the deck repair block 102 and surfaces of corresponding deck boards to be attached to the deck repair block 102. In various embodiments, the deck repair block 102 can comprise an edge (e.g., edge 110) chamfered to correspond to an edge of the first deck board 404 or the second deck board 408. In this regard, the edge 110 between the deck portion 116 and side 108 can be chamfered. The foregoing can maintain a uniform appearance between the deck repair block 102 and corresponding deck boards to be attached to the deck repair block 102.

In various implementations, the first deck board 404 can attach to the first recessed portion 104 using one or more screws (e.g., screws 406). In further implementations, the first deck board 404 can attach to the first recessed portion 104 using an adhesive (not pictured). Likewise, the second deck board 408 can attach to the second recessed portion 106 using one or more screws (e.g., screws 406). In further implementations, the second deck board 408 can attach to the second recessed portion 106 using an adhesive (not pictured). It is noted that such an adhesive can comprise a wood glue or another suitable type of adhesive or glue.

Figure 9:
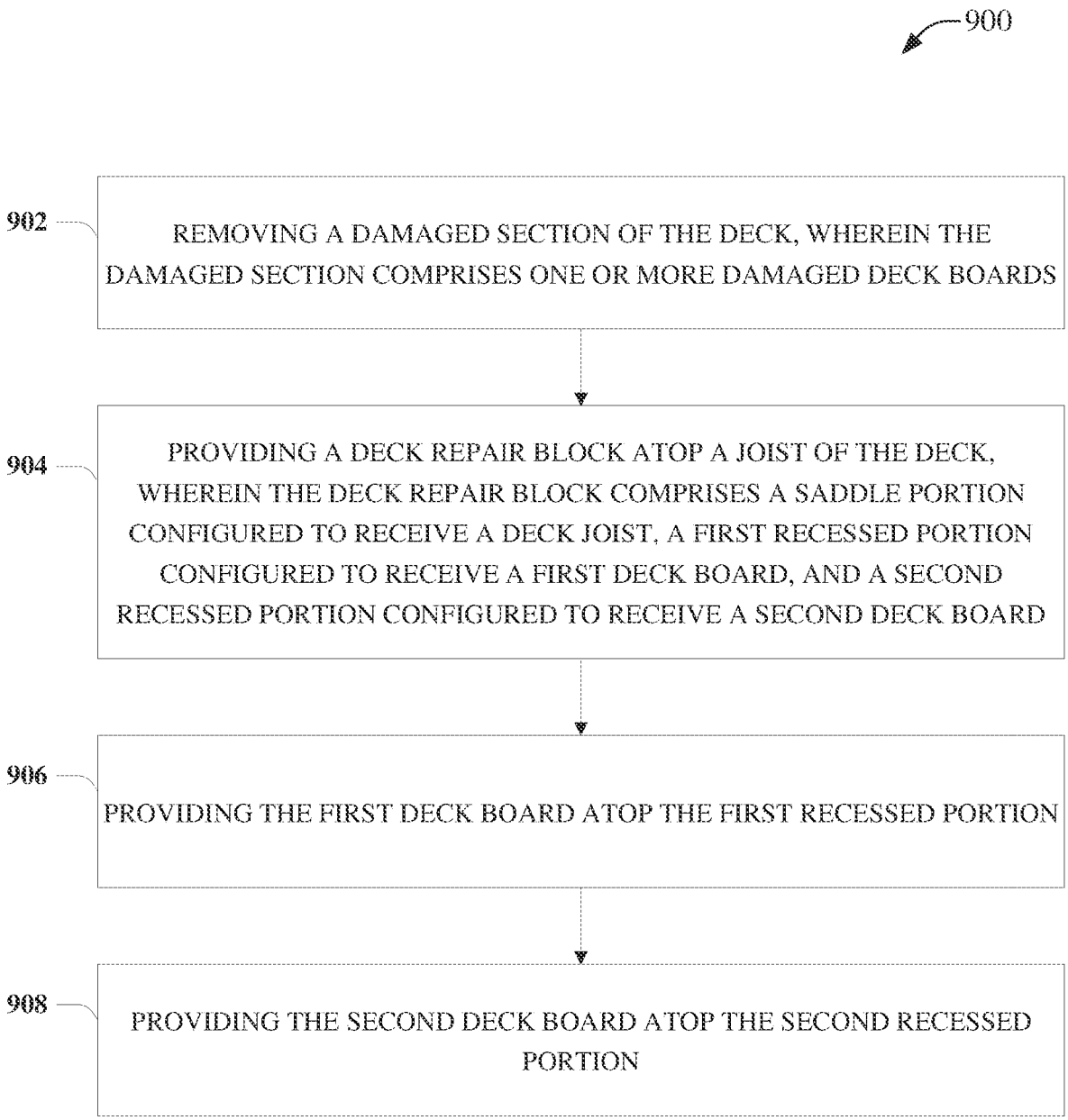
FIG. 9 is a block flow diagram for a process associated with deck repair in accordance with one or more embodiments described herein.

FIG. 9 illustrates a block flow diagram for a process 900 associated with deck repair in accordance with one or more embodiments described herein. At 902, the process 900 can comprise removing a damaged section (e.g., damaged section 502) of the deck (e.g., deck 506), wherein the damaged section (e.g., damaged section 502) comprises one or more damaged deck boards (e.g., first deck board 404 and/or second deck board 408). It is noted that removing the damaged section 502 can comprise removing the screws 504, cutting a first damaged portion 602 from the first deck board 404, and/or cutting a second damaged portion 604 from the second deck board 408. At 904, the process 900 can comprise providing a deck repair block (e.g., deck repair block 102) atop a joist (e.g., joist 402) of the deck (e.g., deck 506), wherein the deck repair block (e.g., deck repair block 102) comprises a saddle portion (e.g., saddle portion 112) configured to receive the joist (e.g., joist 402), a first recessed portion (e.g., first recessed portion 104) configured to receive a first deck board (e.g., first deck board 404), and a second recessed portion (e.g., second recessed portion 106) configured to receive a second deck board (e.g., second deck board 408). At 906, the process 900 can comprise providing the first deck board (e.g., first deck board 404) atop the first recessed portion (e.g., first recessed portion 104). At 908, the process 900 can comprise providing the second deck board (e.g., second deck board 408) atop the second recessed portion (e.g., second recessed portion 106).

According to an embodiment, the process 900 can further comprise securing the first deck board 404 to the first recessed portion 104 with one or more screws 406. In further embodiments, the process 900 can further comprise securing the first deck board 404 to the first recessed portion 104 with an adhesive (not pictured). Similarly, the process 900 can further comprise securing the second deck board 408 to the second recessed portion 106 with one or more screws 406. Likewise, the process 900 can further comprise securing the second deck board 408 to the second recessed portion 106 with an adhesive (not pictured).

In an embodiment, the process 900 can further comprise securing the deck repair block 102 to the joist 402 with an adhesive (not pictured). In further embodiments, the process 900 can further comprise securing the deck repair block 102 to the joist 402 with a bracket (e.g., bracket 410). Such a bracket 410 can comprise an L-bracket or another suitable bracket for securing the deck repair block 102 to the joist 402. One or more screws 412 can be utilized to secure the bracket 410 to the joist 402 and/or the deck repair block 102.

It is noted that utilization of the deck repair block 102 can enable cutting out "the bad" or rotten areas on each butt end (e.g., of a deck board herein), lifting up or removing the bad deck board(s) (e.g., by releasing the fasteners holding it or at least releasing enough fasteners) to allow bending the board(s) upward, then inserting the deck repair block 102 atop the underlying joist (e.g., joist 402) in a "saddle" fashion. The deck repair block 102 can then be secured to the joist by one or more screws (e.g., screw 414 and/or screw 416), adhesive(s), bracket(s), or otherwise secured. Once in place, the deck repair block 102 can receive the deck board(s) that have been cut (e.g., trimmed) to fit on respective sides of the deck repair block 102. Deck boards herein can then be fastened to the outer edge of the deck repair block 102 (e.g., using screws 406, adhesive(s), and/or suitable bracket(s)). The foregoing can enable a secure deck patch without needing to replace entire board(s) to remedy bad deck board ends. It is noted that while the deck repair block 102 can be utilized in deck repair, it can also be utilized in original deck construction.

The above description includes non-limiting examples of the various embodiments. It is, of course, not possible to describe every conceivable combination of components or methods for purposes of describing the disclosed subject matter, and one skilled in the art may recognize that further combinations and permutations of the various embodiments are possible. The disclosed subject matter is intended to embrace all such alterations, modifications, and variations that fall within the spirit and scope of the appended claims.

With regard to the various functions performed by the above-described components, devices, circuits, systems, etc., the terms (including a reference to a "means") used to describe such components are intended to also include, unless otherwise indicated, any structure(s) which performs the specified function of the described component (e.g., a functional equivalent), even if not structurally equivalent to the disclosed structure. In addition, while a particular feature of the disclosed subject matter may have been disclosed with respect to only one of several implementations, such feature may be combined with one or more other features of the other implementations as may be desired and advantageous for any given or particular application.

The terms "exemplary" and/or "demonstrative" as used herein are intended to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent structures and techniques known to one skilled in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

The term "or" as used herein is intended to mean an inclusive "or" rather than an exclusive "or." For example, the phrase "A or B" is intended to include instances of A, B, and both A and B. Additionally, the articles "a" and "an" as used in this application and the appended claims should generally be construed to mean "one or more" unless either otherwise specified or clear from the context to be directed to a singular form.

The term "set" as employed herein excludes the empty set, i.e., the set with no elements therein. Thus, a "set" in the subject disclosure includes one or more elements or entities. Likewise, the term "group" as utilized herein refers to a collection of one or more entities.

The description of illustrated embodiments of the subject disclosure as provided herein, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as one skilled in the art can recognize. In this regard, while the subject matter has been described herein in connection with various embodiments and corresponding drawings, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A deck repair block, comprising:
a saddle portion configured to receive a joist;
a first recessed portion configured to receive a first deck board; and
a second recessed portion configured to receive a second deck board, wherein the first recessed portion and the second recessed portion are on respective opposite sides of the deck repair block, separated by the saddle portion.

2. The deck repair block of claim 1, wherein a first depth of the first recessed portion corresponds to a first thickness of the first deck board, and wherein a second depth of the second recessed portion corresponds to a second thickness of the second deck board.

3. The deck repair block of claim 2, wherein a thickness of a deck portion of the deck repair block corresponds to the first thickness of the first deck board and the second thickness of the second deck board.

4. The deck repair block of claim 1, wherein a width of the saddle portion corresponds to a thickness of the joist, and wherein a depth of the saddle portion corresponds to a depth of the first recessed portion or second recessed portion.

5. The deck repair block of claim 1, wherein the first recessed portion attaches to the first deck board using one or more screws.

6. The deck repair block of claim 1, wherein the first recessed portion attaches to the first deck board using a glue.

7. The deck repair block of claim 1, wherein the deck repair block comprises wood.

8. The deck repair block of claim 1, wherein the deck repair block comprises a composite material.

9. The deck repair block of claim 1, further comprising:
an edge chamfered to correspond to an edge of the first deck board or the second deck board.

10. A deck, comprising:
a deck repair block received atop a joist;
a first deck board received on a first recessed portion of the deck repair block; and
a second deck board received on a second recessed portion of the deck repair block, wherein the first recessed portion and the second recessed portion are on respective opposite sides of the deck repair block, separated by the joist.

11. The deck of claim 10, wherein a top surface of the deck repair block corresponds to a replacement section of the deck.

12. The deck of claim 11, wherein the replacement section comprises a first portion of the first deck board and a second portion of the second deck board.

13. The deck of claim 10, wherein the first deck board, the second deck board, and the deck repair block comprise a common material.

14. A method for repairing a deck, comprising:

removing a damaged section of the deck, wherein the damaged section comprises one or more damaged deck boards;

providing a deck repair block atop a joist of the deck, wherein the deck repair block comprises a saddle portion configured to receive the joist, a first recessed portion configured to receive a first deck board, and a second recessed portion configured to receive a second deck board;

providing the first deck board atop the first recessed portion; and providing the second deck board atop the second recessed portion, wherein the first recessed portion and the second recessed portion are on respective opposite sides of the deck repair block, separated by the saddle portion.

15. The method for repairing a deck of claim 14, wherein the one or more damaged deck boards comprise the first deck board and the second deck board.

16. The method for repairing a deck of claim 14, further comprising:

securing the first deck board to the first recessed portion with one or more screws.

17. The method for repairing a deck of claim 14, further comprising:

securing the first deck board to the first recessed portion with an adhesive.

18. The method for repairing a deck of claim 14, further comprising:

securing the deck repair block to the joist with an adhesive.

19. The method for repairing a deck of claim 14, further comprising:

securing the deck repair block to the joist with one or more of a bracket or one or more screws.

20. The method for repairing a deck of claim 14, wherein a length of the damaged section corresponds to a length of a top surface of the deck repair block.

* * * * *